US005360033A

United States Patent [19]

Williams et al.

[11] Patent Number: 5,360,033

[45] Date of Patent: Nov. 1, 1994

[54] OIL TRANSFER SYSTEM

[75] Inventors: Tom Williams, Erin; Larry Goertzen, Waterloo, both of Canada

[73] Assignee: Ecologic Waste Systems Corporation, Milton, Canada

[21] Appl. No.: 111,769

[22] Filed: Aug. 25, 1993

[30] Foreign Application Priority Data

Aug. 27, 1992 [CA] Canada ..... 2077024

[51] Int. Cl.[5] ..... F04B 49/10

[52] U.S. Cl. ..... 137/565; 137/568; 137/558; 417/9; 417/36

[58] Field of Search ..... 137/551, 565, 568, 558; 417/9, 36

[56] References Cited

U.S. PATENT DOCUMENTS

| | | | |
|---|---|---|---|
| 3,340,892 | 9/1967 | Holland | 137/558 |
| 3,509,825 | 5/1970 | Sorensen | 417/36 |
| 3,540,027 | 11/1970 | Rauth et al. | 417/36 |
| 4,242,575 | 12/1980 | Callahan et al. . | |
| 4,244,385 | 1/1981 | Hotine | 417/36 |
| 4,380,243 | 4/1983 | Braley | 137/558 |
| 4,511,311 | 4/1985 | Olson | 417/36 |
| 4,600,844 | 7/1986 | Atkins | 417/36 |
| 4,948,340 | 8/1990 | Solomon et al. | 137/565 |
| 5,016,689 | 5/1991 | McGarvey et al. | 417/9 |

FOREIGN PATENT DOCUMENTS 1285046 2/1991 Canada .

*Primary Examiner*—A. Michael Chambers

*Attorney, Agent, or Firm*—Arne I. Fors; Jeffrey T. Imai

[57] ABSTRACT

A hazardous fluid removal and storage apparatus for the fail-safe removal and storage of hazardous liquids. An electrically monitored and electro-pneumatically controlled system provides safe pumping and storage of hazardous liquids with automatic pump shut-down and warning signals for leak detection and full storage tank conditions.

6 Claims, 2 Drawing Sheets

OIL TRANSFER SYSTEM

BACKGROUND OF THE INVENTION

The present invention relates to a waste oil removal apparatus and, more particularly, relates to a fail-safe apparatus for removal and storage of hazardous liquids.

The transfer and storage of waste oil or like hazardous liquid has resulted in environmentally dangerous spills. It is known to place a limit switch in a storage tank to indicate full capacity and it is also known to provide a containment means in the event of a leak. However a faulty switch or a poor connection from the switch to the control panel may result in a spill situation.

It is an object of the present invention to provide an apparatus for the fail-safe removal and storage of hazardous liquids. It is desired that the system be fail-safe in that pumping will cease in the event of a leak detection in a storage tank or upon filling the storage tank to capacity. Also it is desirable that the system be provided with visual and audio modes for the reliable identification of full (i.e. 95% full) or leaking conditions.

SUMMARY OF THE INVENTION

The hazardous liquid removal and storage apparatus of the present invention comprises an air operated pumping means operatively connected at its suction port to a hazardous liquid container, at its discharge port to a storage tank, and at its air supply port to an electrically operated solenoid valve; and an electrical control circuit connected in series comprised of a tank leak indicator switch, located in the containment tank, an ON/OFF switch, an electrically operated solenoid valve and a storage tank full switch located in the storage tank.

In a more specific embodiment, a signal light is connected in parallel to the series control circuit to indicate sufficient power supply, a warning circuit having visual and audio signalling means is connected in series with the full storage tank switch, and a second warning circuit having signalling means is connected in series with the tank leak indicator switch.

In its broad aspect, the hazardous liquid removal and storage apparatus comprises, in combination an enclosed liquid storage tank, an enclosed containment tank in which the storage tank is placed, a liquid container for receiving hazardous liquid fluids to be disposed, an air-actuated liquid pump in communication with the liquid container and the storage tank for transferring liquid from the liquid container to the storage tank, a pressurized air supply for actuating the liquid pump, and an electrically energized solenoid actuated valve in the air supply for controlling the flow of air to the pump, and a leak detector sensor in said containment tank and a tank full sensor in the storage tank in a normally-closed series-connected control circuit in electrical series with the solenoid-actuated valve for normally actuating the solenoid valve to permit the flow of pressurized air to the liquid pump for actuation of the pump whereby sensing of a leak by the leak detector or sensing of a full tank by the tank full sensor will open the said series connected control circuit to de-energize the solenoid and stop the flow of air to the pump to cease the transfer of the liquid liquid.

BRIEF DESCRIPTION OF THE DRAWINGS

The apparatus of the invention and its method of operation will now be described with reference to the accompanying drawings, in which:

FIG. 1-A is an enlarged view of the control panel shown in FIG. 1; and

DESCRIPTION OF THE PREFERRED EMBODIMENT

Figure 1:
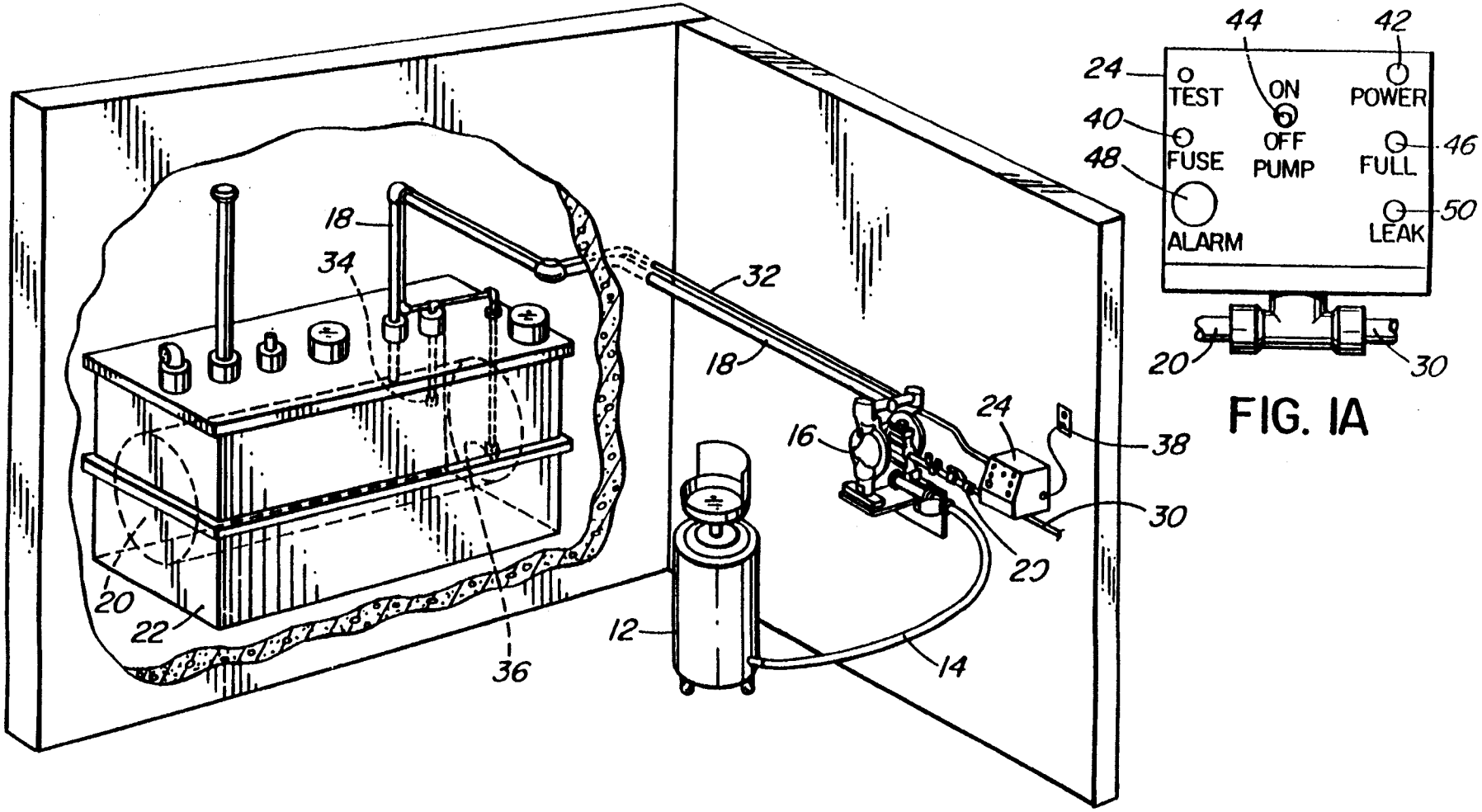
FIG. 1 is a schematic representation, partly cut away, of the hazardous liquid removal apparatus of the present invention.

With reference to FIG. 1, a hazardous liquid, such as liquid crankcase oil requiring disposal, is contained in a hazardous liquid container 12. An air operated pump 16, in communication with air supply line 21 via an electrically-operated solenoid valve 28 and air supply line 30, is employed to draw hazardous liquid from container 12 through a suction line 14 and discharge said hazardous liquid to a storage tank 20 via discharge line 18. The storage tank 20 is positioned within a containment tank 22 as a precautionary means to contain any leaked hazardous liquid from said storage tank 20.

Control panel 24 comprising a single-pole single-throw ON/OFF switch 44, a green power light 42, a red tank full light 46, a red leak detected light 50 and an intermittent buzzer 48 is electrically connected to the electrically operated solenoid valve 28 housed therein, the 95% full proximity sensor 34, and the tank leak proximity sensor 36 through electrical conduit 32.

Figure 2:
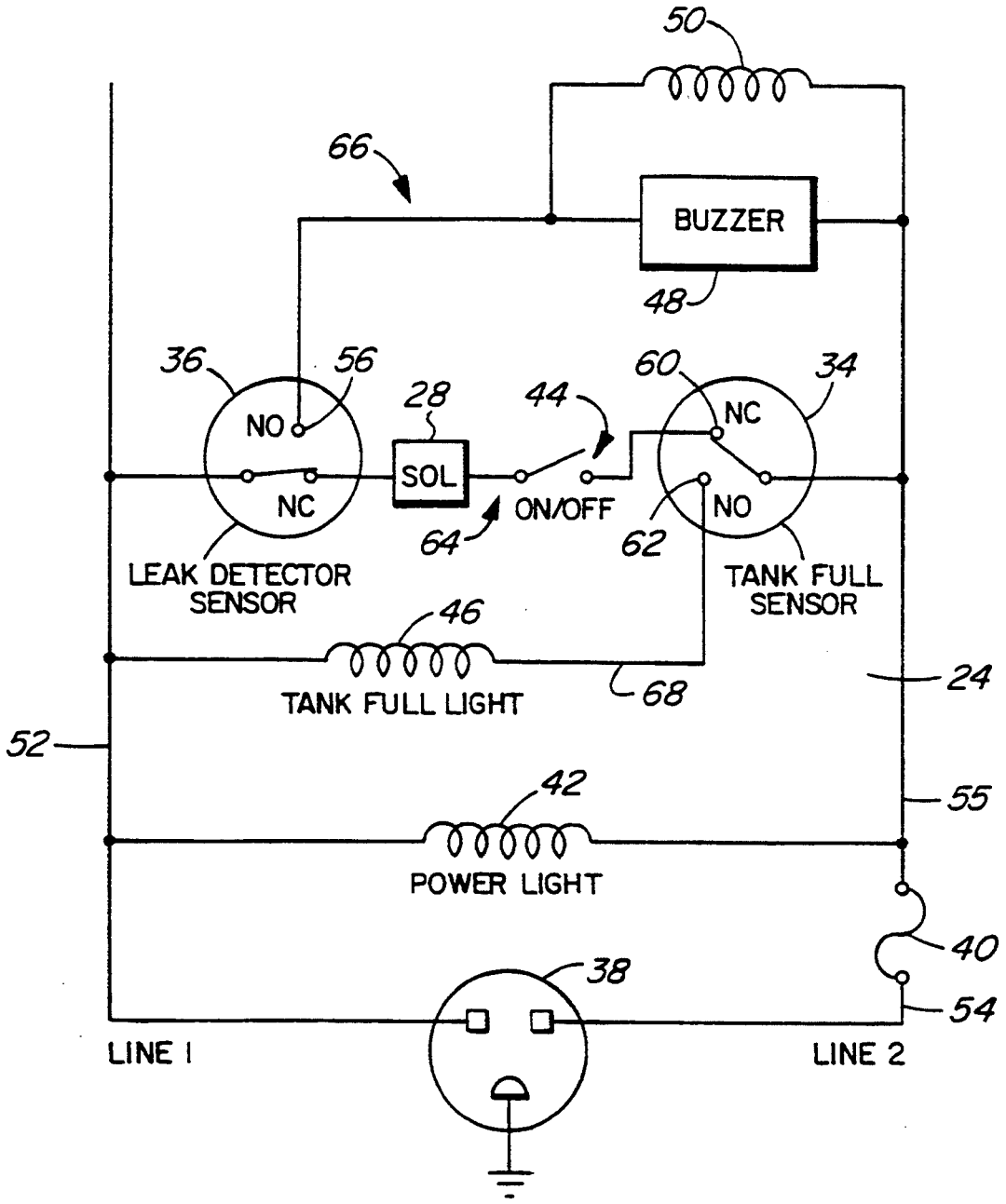
FIG. 2 is an electrical schematic, in the form of a ladder diagram, of the electrical circuit of the present invention.

Referring now also to FIG. 2, a schematic representation of the electrical circuitry of the present invention, a power source of 120 volt AC is received through a standard 120 volt AC male plug 38 and carried to control panel 24 shown in more detail in FIG. 1-A via lines 52 and 54, fuse 40 being connected in series in line 54 to protect the circuitry in the event of an electrical short. Power light 42, connected between line 52 and fused line 55, will illuminate to confirm fuse 40 is intact and power is being received.

Closing the ON/OFF switch 44, while normally-closed contact 58 of the single-pole double-throw tank leak proximity sensor 36 and normally-closed contact 60 of the single-pole double-throw tank 95% full proximity sensor 34 are closed, completes the circuit 64 between line 52 and fused line 55 and energizes the electrically-operated air solenoid 28, allowing air to flow to the air-operated pump 16 and the subsequent pumping of hazardous liquid to the storage tank 20.

A parallel circuit 68 comprises normally-open contact 62 of the 95% full proximity sensor 34, located inside the storage tank, and a full tank indicator light 46. Sensing of liquid by the 95% full proximity sensor 34 as the storage tank 20 nears capacity will open contact 60 of said sensor 34 disrupting current flow through circuit 64 de-energizing electrically operated solenoid valve 28, thus terminating flow of hazardous liquid, and close contact 62 of said sensor 34 diverting current to flow through circuit 68 energizing full tank light 46.

A second parallel circuit 66 comprises the tank leak proximity sensor 36, located at the bottom of the containment tank, connected in series with a parallel arrangement of the intermittent buzzer 48 and the leak detection light 50. Upon detecting escaping liquid in the containment tank 22, contact 58 of the tank leak proximity sensor 36 is opened terminating electrical flow to the electrically operated solenoid valve 28, thus ceasing the flow of hazardous liquid. Contact 56 is closed diverting current through circuit 66 energizing the intermittent buzzer 48 and the leak detected light 50 causing said buzzer 48 to sound and said leak detection light 50 to illuminate as warning of leak detection.

The hazardous liquid removal apparatus of the present invention provides a number of advantages. The storage tank 95% full proximity sensor 34 and the tank leak proximity sensor 36 are arranged in series with the electrically operated solenoid valve 28 to provide an intrinsically safe circuit producing automatic pump shut-down in the event of a storage tank 20 leak, a 95% full storage tank 20, or a poor electrical connection, sensor damage or sensor disconnection. The invention also provides visual and audio warning alarms concurrent with automatic shut-down due to leak detection and visual alarm upon 95% full detection as well as a visual indicator of power supply and fuse conditions.

A switch may be connected between line 52 and line 66 and a second switch may be connected between lines 55 and 68 to allow for the testing of intermittent buzzer 48 and tank full indicator light 46 respectively.

It will be understood, of course, that modifications can be made in the embodiments of the invention illustrated and described herein without departing from the scope and purview of the invention as defined by the appended claims.

I claim:

1. A hazardous liquid removal and storage apparatus comprising, in combination:

an enclosed liquid storage tank;

an enclosed containment tank in which the storage tank is placed;

a liquid container for receiving hazardous liquid liquids to be disposed remote from the liquid storage tank and containment tank;

an air-actuated liquid pump in communication with the liquid container and the storage tank located intermediate the liquid storage tank and containment tank and the liquid container for transferring liquid from the liquid container to the storage tank;

a pressurized air supply for actuating the liquid pump;

an electrically energized solenoid actuated valve in the air supply separate from and remote from the liquid storage tank and containment tank for controlling the flow of air to the pump;

a control panel separate from and remote from the liquid storage tank and containment tank housing the electrically energized solenoid actuated valve and an electrical control circuit, said electrical control circuit having a pair of normally-closed electrical switches in series with the electrically energized solenoid actuated valve in the air supply;

a leak detector sensor in said containment tank and a tank full sensor in the storage tank each in electrical communication with one of the pair of normally-closed electrical switches to form a normally-closed series connected control circuit in electrical series with the solenoid-actuated valve for normally actuating the solenoid valve to permit the flow of pressurized air to the liquid pump for actuation of the pump, whereby sensing of a leak by the leak detector or sensing of a full tank by the tank full sensor will open the said series connected control circuit to de-energize the solenoid and stop the flow of air to the pump to cease the transfer of the liquid.

2. A hazardous liquid removal and storage apparatus as claimed in claim 1 in which a green light is mounted on the control panel and is electronically connected in parallel with the series connected control circuit to indicate the presence of electrical power.

3. A hazardous liquid removal and storage apparatus as claimed in claim 1 in which a warning device is electrically connected in a first warning circuit in parallel with the series connected control circuit and in series with the leak detector sensor and wherein said pair of normally-closed electrical switches are double throw switches each having a normally-closed and a normally-open position whereby sensing of a leak by the leak detector will open a normally-closed electrical switch and close the normally-open electrical switch to closed the said warning circuit for energizing of said warning device.

4. A hazardous liquid removal and storage apparatus as claimed in claim 3 in which the warning device comprises an intermittent buzzer and a red light electrically connected in parallel with each other.

5. A hazardous liquid removal and storage apparatus as claimed in claim 1 in which a warning device is electrically connected in a second warning circuit in parallel with the series connected control circuit and in series with the tank full sensor and wherein said pair of normally-closed electrical switches are double throw switches each having a normally-closed and a normally-open position whereby sensing of a full tank by the full tank detector will open a normally-closed electrical switch of the series connected control circuit and close the normally-open electrical switch to close the second warning circuit for energizing of said warning device.

6. A hazardous liquid removal and storage apparatus as claimed in claim 5 in which the warning device comprises a red light mounted on the control panel.

* * * * *